US007963313B1

(12) United States Patent
Bennett et al.

(10) Patent No.: US 7,963,313 B1
(45) Date of Patent: Jun. 21, 2011

(54) WIND ABATEMENT SYSTEM

(76) Inventors: Wayne E. Bennett, Brooksville, FL (US); Rosalie Bennett, Brooksville, FL (US)

( * ) Notice: Subject to any disclaimer, the term of this patent is extended or adjusted under 35 U.S.C. 154(b) by 321 days.

(21) Appl. No.: 12/228,042

(22) Filed: Aug. 8, 2008

(51) Int. Cl.
*E06B 3/30* (2006.01)

(52) U.S. Cl. ..... 160/368.1; 160/327; 52/222

(58) Field of Classification Search ..... 160/368.1, 160/327, 354, 127, 264, 237; 52/202, 222, 52/63, 3
See application file for complete search history.

(56) References Cited

U.S. PATENT DOCUMENTS 2,146,251 A * 2/1939 Deminick ..... 160/328
2,169,103 A * 8/1939 Lesley ..... 160/179
3,480,069 A * 11/1969 Handwerker ..... 160/354
4,836,265 A * 6/1989 Bussert ..... 160/354
6,176,050 B1 1/2001 Gower
6,978,579 B1 * 12/2005 Trinca ..... 52/203
2004/0154242 A1 * 8/2004 Hudoba et al. ..... 52/202
2007/0101666 A1 * 5/2007 Munch ..... 52/202
2008/0313980 A1 * 12/2008 Holland et al. ..... 52/202

* cited by examiner

*Primary Examiner* — David Purol

(57) ABSTRACT

A fabric panel has an interior and exterior face with a top, a bottom, and sides. An upper seam forms an upper passageway. A lower seam forms a lower passageway. A bar is secured within each hem. A plurality of support holes extends through the hem and bar at the top and at the bottom of the primary panel. A plurality of threaded bolts are provided. Each bolt has a threaded end. The threaded end is adapted to be received by recipient surfaces adjacent to the top and bottom of the panel. Each bolt has an exposed end. In this manner coupling and uncoupling is facilitated. Each bolt has a central portion. The central portion extends through a hole in a hem and bar at the top and at the bottom of the panel.

8 Claims, 4 Drawing Sheets

FIG 3
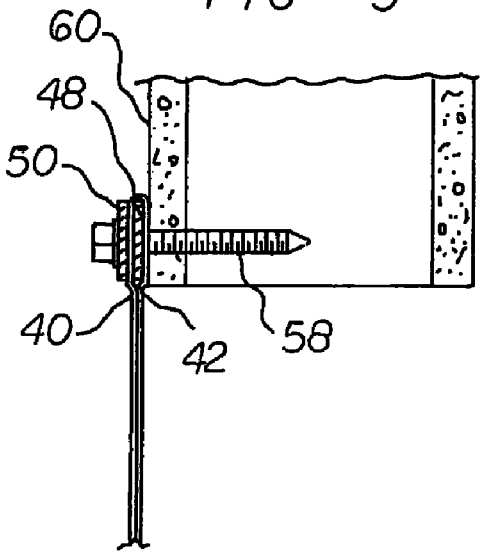
FIG 4
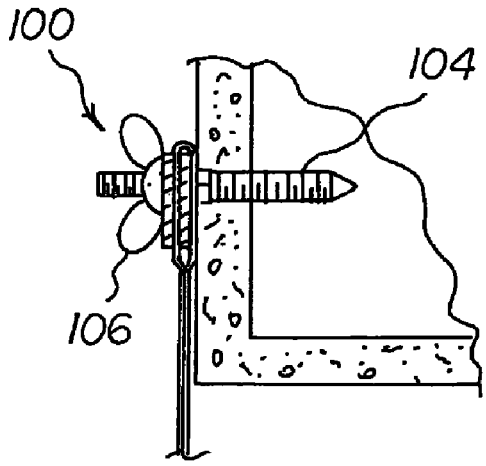
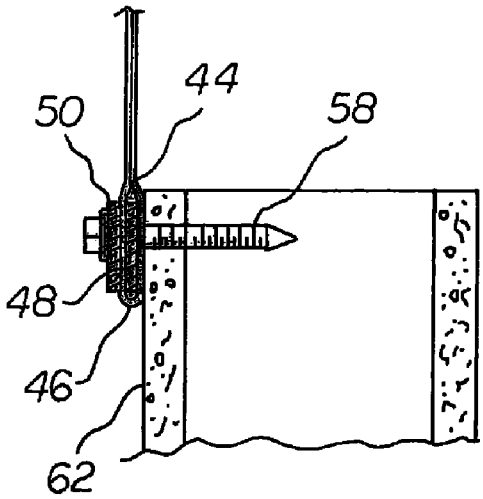
FIG 5
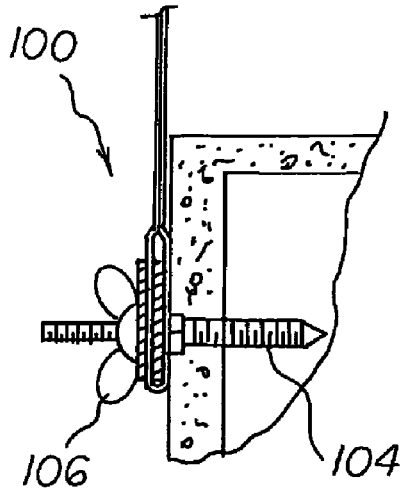
FIG 6

FIG 7
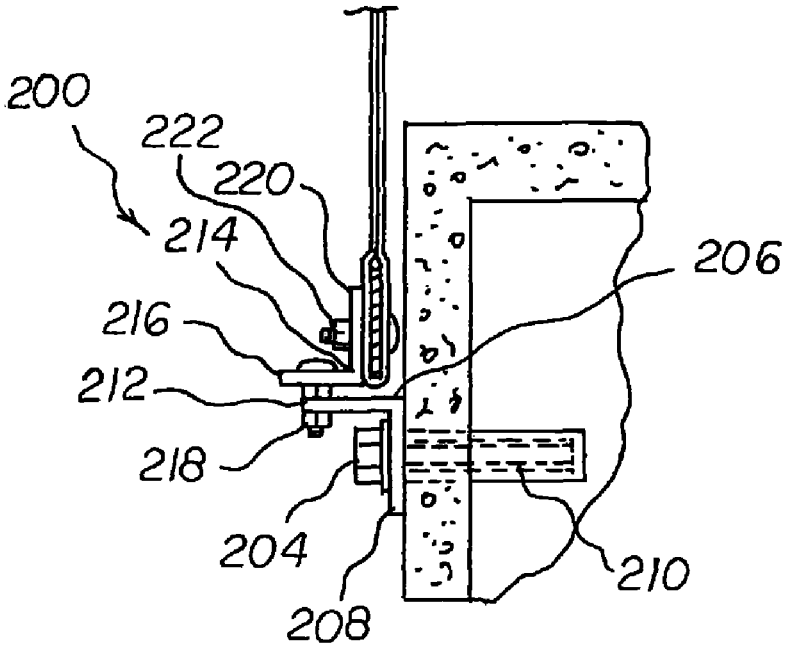
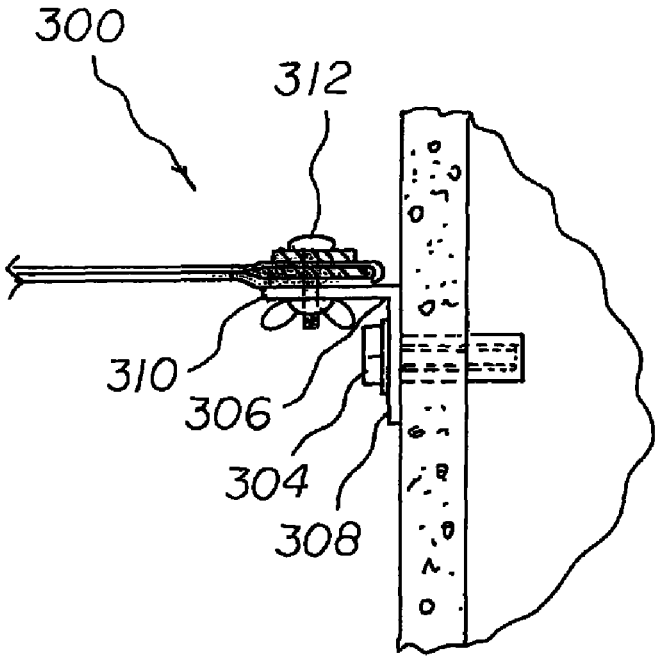
FIG 8

WIND ABATEMENT SYSTEM

BACKGROUND OF THE INVENTION

1. Field of the Invention

The present invention relates to a wind abatement system and more particularly pertains to making structures, including homes, lanais, entrances, windows, garages and the like secure from high winds and hurricanes in a safe, convenient and economical manner.

2. Description of the Prior Art

The use of wind protection systems of known designs and configurations is known in the prior art. More specifically, wind protection systems of known designs and configurations previously devised and utilized for the purpose of protecting structures from wind through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,176,050 issued Jan. 23, 2001 to Gower relates to a Flexible Protective Wind Abatement System.

While this devices fulfills its objectives and requirements, the aforementioned patent does not describe a wind abatement system that allows for making structures, including homes, lanais, entrances, windows, garages and the like secure from high winds and hurricanes in a safe, convenient and economical manner.

In this respect, the wind abatement system according to the present invention substantially departs from the conventional concepts and designs of the prior art, and in doing so provides an apparatus primarily developed for the purpose of making structures, including homes, lanais, entrances, windows, garages and the like secure from high winds and hurricanes in a safe, convenient and economical manner.

Therefore, it can be appreciated that there exists a continuing need for a new and improved wind abatement system which can be used for making structures, including homes, lanais, entrances, windows, garages and the like secure from high winds and hurricanes in a safe, convenient and economical manner. In this regard, the present invention substantially fulfills this need.

SUMMARY OF THE INVENTION

In view of the foregoing disadvantages inherent in the known types of wind protection systems of known designs and configurations now present in the prior art, the present invention provides an improved wind abatement system. As such, the general purpose of the present invention, which will be described subsequently in greater detail, is to provide a new and improved wind abatement system and method which has all the advantages of the prior art and none of the disadvantages.

To attain this, the present invention essentially comprises a wind abatement system. First provided is a fabric primary panel. The primary panel is in a rectangular configuration. The primary panel has an interior face. The primary panel has an exterior face. The primary panel has a horizontal top. The primary panel has a parallel horizontal bottom. The primary panel has parallel vertical sides. The top has an upper free edge. The upper free edge has a plurality of parallel seams. The preferred embodiment includes 6 seams. The seams are spaced apart by about 0.5 inches adjacent to the upper free edge. The upper free edge is folded outwardly and overlapped about 16 inches with the plurality of parallel seams. The bottom has a lower free edge. The lower free edge has a plurality of parallel seams. The preferred embodiment includes 6 seams. The seams are spaced apart by about 0.5 inches adjacent to the lower free edge. The lower free edge is folded outwardly and overlapped about 16 inches the plurality of parallel seams. The sides have lateral free edges. The lateral free edges have a plurality of parallel seams. The preferred embodiment includes 4 parallel seams. The seams are spaced apart by about 3 inches adjacent to the lateral free edge. The lateral free edges are folded inwardly and overlapped about 16 inches with the plurality of parallel seams.

Reinforcing components are provided. The reinforcing components include an upper seam. The upper seam is provided about 1.75 inches from the top. In this manner an upper passageway is formed. The reinforcing components include a lower seam. The lower seam is provided about 1.75 inches from the bottom. In this manner a lower passageway is formed. The reinforcing components include a flat primary bar. The flat primary bar measures about 144 inches long and about 1.5 inches wide and about 0.125 inches thick. The flat primary bar is adhesively secured within each hem. The reinforcing components include a flat secondary bar. The flat secondary bar measures about 144 inches long and about 1.0 inches wide and about 0.125 inches thick. The flat secondary bar is adhesively secured exteriorly of each hem. The reinforcing components further include a plurality of aluminum pop rivets. The rivets join the hem and bars at the top and at the bottom. The reinforcing components includes a plurality of support holes. The support holes extend through the hem and bars at the top and at the bottom of the primary panel.

Provided next is a plurality of threaded bolts. Each bolt has a threaded end. Recipient surfaces are provided. The threaded end is adapted to be received and supported by the recipient surfaces adjacent to the top and bottom of the primary panel. Each bolt has a head end. The head end is exposed. In this manner rotation is facilitated for coupling and uncoupling purposes. Each bolt has a central portion. The central portion extends through a hole in a hem and bars at the top and at the bottom of the primary panel.

Further provided is a fabric secondary panel. The secondary panel is in a rectangular configuration. The secondary panel has an interior face. The secondary panel has an exterior face. The exterior face of the secondary panel faces the interior face of the primary panel. The secondary panel has a horizontal top. The secondary panel has a parallel horizontal bottom. The secondary panel has parallel vertical sides. The vertical sides are adapted to overlie the sides of the primary panel. A joining seam is provided. The joining seam extends through the secondary panel adjacent to the top of the secondary panel and through the primary panel about 2.5 inches from the top of the primary panel. The secondary panel has a plurality of holes. The holes have grommets. The holes are adapted to overlie support holes. The holes further extend through the hem and bars at the top of the primary panel. In this manner fasteners through the holes at the top of the primary panel and through the holes and grommets at the bottom of the secondary panel will form a cylindrical pocket for receiving the primary panel when wound spirally into a storage inoperative orientation adjacent to a recipient surface. Further in this manner the holes and grommets at the bottom of the secondary panel will hang downwardly when the primary panel hangs downwardly in a deployed operative orientation.

The bars are fabricated of aluminum. The panels are fabricated of woven from an essentially inextensible monofilament polymer fiber, preferably 100 percent polypropylene, having a 565 denier in a 3×4 plain weave with 60 threads per inch in the warp and 50 ends per inch in the fill, and having a 90 percent shade factor. The seams are constructed of black thread.

Provided last is a hanger tab. The hanger tab has an interior end. The interior end is attached to the primary panel adjacent to one side edge and an exterior edge. A hole and a support grommet are provided remote from the primary panel. A hook is provided. The support grommet is adapted to receive the hook. In this manner storage is provided when the panels are in a storage inoperative orientation remote from a recipient surface.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wind abatement system which has all of the advantages of the prior art wind protection systems of known designs and configurations and none of the disadvantages.

It is another object of the present invention to provide a new and improved wind abatement system which may be easily and efficiently manufactured and marketed.

It is further object of the present invention to provide a new and improved wind abatement system which is of durable and reliable constructions.

An even further object of the present invention is to provide a new and improved wind abatement system which is susceptible of a low cost of manufacture with regard to both materials and labor, and which accordingly is then susceptible of low prices of sale to the consuming public, thereby making such wind abatement system economically available to the buying public.

Even still another object of the present invention is to provide a wind abatement system for making structures, including homes, lanais, entrances, windows, garages and the like secure from high winds and hurricanes in a safe, convenient and economical manner.

Lastly, it is an object of the present invention to provide a new and improved wind abatement system. A fabric panel has an interior and exterior face with a top, a bottom, and sides. An upper seam forms an upper passageway. A lower seam forms a lower passageway. A bar is secured within each hem. A plurality of support holes extends through the hem and bar at the top and at the bottom of the primary panel. A plurality of threaded bolts are provided. Each bolt has a threaded end. The threaded end is adapted to be received by recipient surfaces adjacent to the top and bottom of the panel. Each bolt has an exposed end. In this manner coupling and uncoupling is facilitated. Each bolt has a central portion. The central portion extends through a hole in a hem and bar at the top and at the bottom of the panel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an enlarged side elevational view taken at Circle 3 of FIG. 2.

FIG. 4 is an enlarged side elevational view similar to FIG. 3 but illustrating an alternate embodiment of the invention.

FIG. 5 is an enlarged side elevational view taken at Circle 4 of FIG. 2.

FIG. 6 is an enlarged side elevational view similar to FIG. 5 but illustrating another alternate embodiment of the invention.

FIGS. 7 and 8 are enlarged side elevational views of additional alternate embodiments of the invention.

The same reference numerals refer to the same parts throughout the various Figures.

DESCRIPTION OF THE PREFERRED EMBODIMENT

Figure 1:
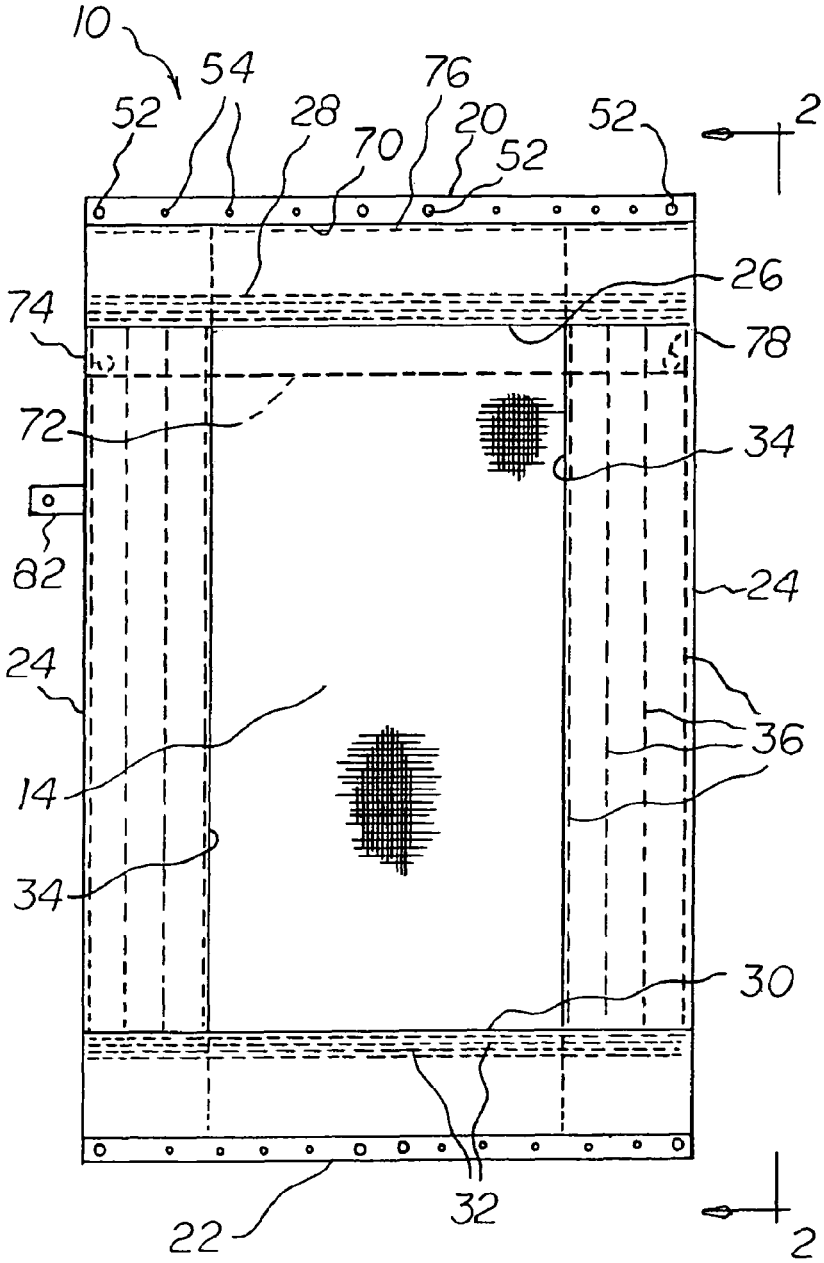
FIG. 1 is a front elevational view of a wind abatement system constructed in accordance with the principles of the present invention, the wind abatement system being in a deployed operative orientation.

With reference now to the drawings, and in particular to FIG. 1 thereof, the preferred embodiment of the new and improved wind abatement system embodying the principles and concepts of the present invention and generally designated by the reference numeral 10 will be described.

The present invention, the wind abatement system 10 is comprised of a plurality of components. Such components in their broadest context include a fabric panel, an upper seam and a plurality of threaded bolts. Such components are individually configured and correlated with respect to each other so as to attain the desired objective.

First provided is a fabric primary panel 14. The primary panel is in a rectangular configuration. The primary panel has an interior face 16. The primary panel has an exterior face 18.

The primary panel has a horizontal top 20. The primary panel has a parallel horizontal bottom 22. The primary panel has parallel vertical sides 24. The top has an upper free edge 26. The upper free edge has a plurality of parallel seams 28. The preferred embodiment includes 6 seams. The seams are spaced apart by about 0.5 inches adjacent to the upper free edge. The upper free edge is folded outwardly and overlapped about 16 inches with the plurality of parallel seams. The bottom has a lower free edge 30. The lower free edge has a plurality of parallel seams 32. The preferred embodiment includes 6 seams. The seams are spaced apart by about 0.5 inches adjacent to the lower free edge. The lower free edge is folded outwardly and overlapped about 16 inches the plurality of parallel seams. The sides have lateral free edges 34. The lateral free edges have a plurality of parallel seams 36. The preferred embodiment includes 4 parallel seams. The seams are spaced apart by about 3 inches adjacent to the lateral free edge. The lateral free edges are folded inwardly and overlapped about 16 inches with the plurality of parallel seams.

Reinforcing components are provided. The reinforcing components include an upper seam 40. The upper seam is provided about 1.75 inches from the top. In this manner an upper passageway 42 is formed. The reinforcing components include a lower seam 44. The lower seam is provided about 1.75 inches from the bottom. In this manner a lower passageway 46 is formed. The reinforcing components include a flat primary bar 48. The flat primary bar measures about 144 inches long and about 1.5 inches wide and about 0.125 inches thick. The flat primary bar is adhesively secured within each hem. The reinforcing components include a flat secondary bar 50. The flat secondary bar measures about 144 inches long and about 1.0 inches wide and about 0.125 inches thick. The flat secondary bar is adhesively secured exteriorly of each hem. The reinforcing components further include a plurality of aluminum pop rivets 52. The rivets join the hem and bars at the top and at the bottom. The reinforcing components includes a plurality of support holes 54. The support holes extend through the hem and bars at the top and at the bottom of the primary panel.

Provided next is a plurality of threaded bolts 58. Each bolt has a threaded end. Recipient surfaces 60, 62 are provided. The threaded end is adapted to be received and supported by the recipient surfaces adjacent to the top and bottom of the primary panel. Each bolt has a head end. The head end is exposed. In this manner rotation is facilitated for coupling and uncoupling purposes. Each bolt has a central portion. The central portion extends through a hole in a hem and bars at the top and at the bottom of the primary panel.

Figure 2:
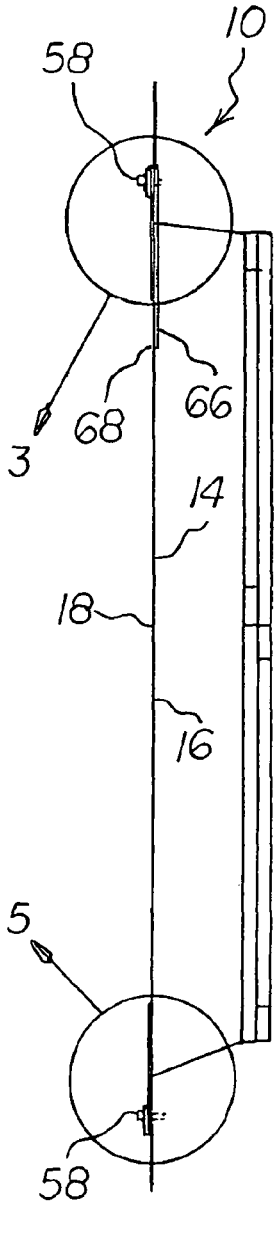
FIG. 2 is a side elevational view of the wind abatement system taken at line 2-2 of FIG. 1.
Figure 9:
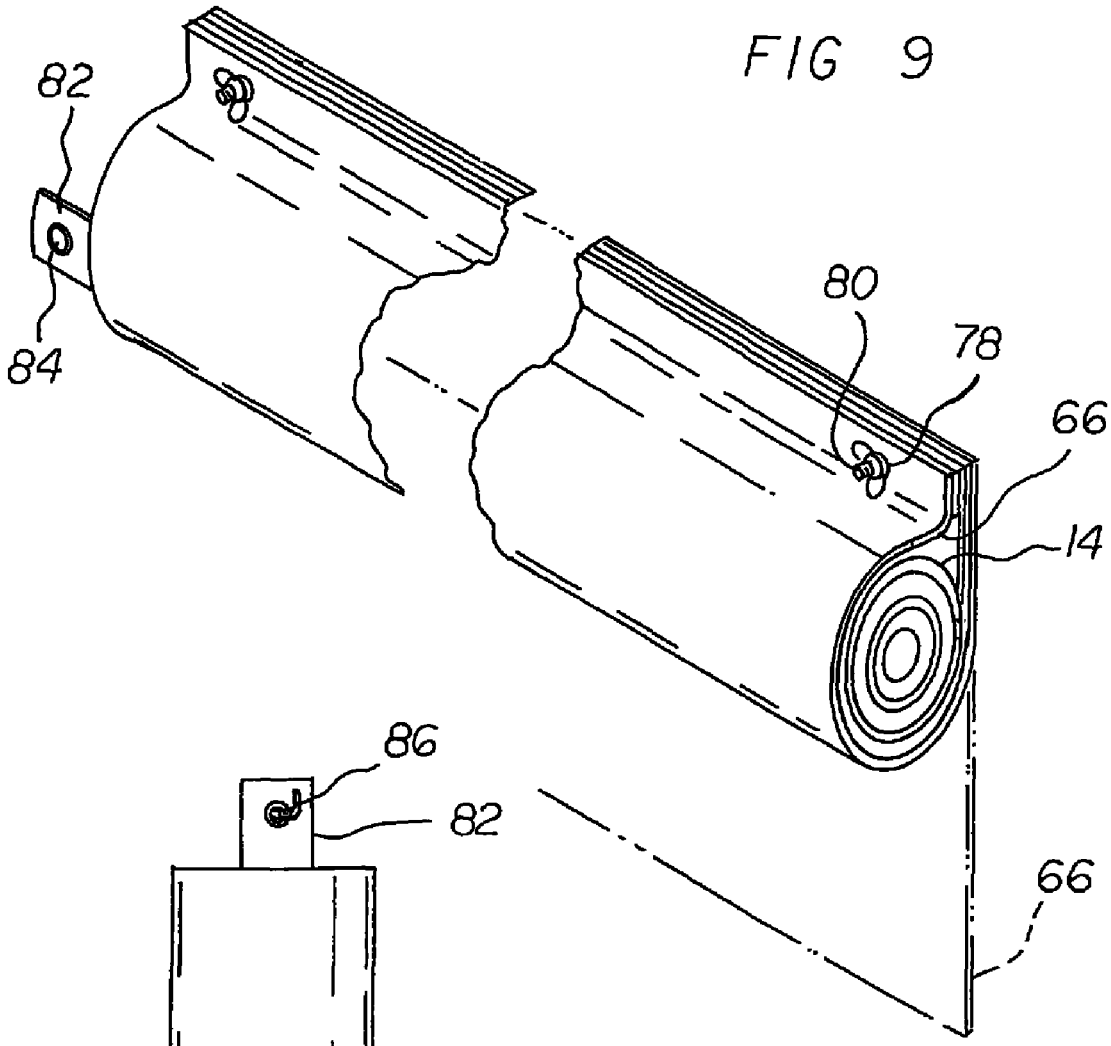
FIG. 9 is a perspective illustration of the wind abatement system in a storage inoperative orientation adjacent to a window.

Further provided is a fabric secondary panel 66. The secondary panel is in a rectangular configuration. The secondary panel has an interior face. The secondary panel has an exterior face 68. The exterior face of the secondary panel faces the interior face of the primary panel. The secondary panel has a horizontal top 70. The secondary panel has a parallel horizontal bottom 72. The secondary panel has parallel vertical sides 74. The vertical sides are adapted to overlie the sides of the primary panel. A joining seam 76 is provided. The joining seam extends through the secondary panel adjacent to the top of the secondary panel and through the primary panel about 2.5 inches from the top of the primary panel. The secondary panel has a plurality of holes. The holes have grommets 78. The holes are adapted to overlie support holes. The holes further extend through the hem and bars at the top of the primary panel. In this manner fasteners through the holes at the top of the primary panel and through the holes and grommets at the bottom of the secondary panel will form a cylindrical pocket for receiving the primary panel when wound spirally into a storage inoperative orientation adjacent to a recipient surface. Note FIG. 9. Further in this manner the holes and grommets at the bottom of the secondary panel will hang downwardly when the primary panel hangs downwardly in a deployed operative orientation. Note FIGS. 1 and 2.

The bars are fabricated of aluminum. The panels are fabricated of woven from an essentially inextensible monofilament polymer fiber, preferably 100 percent polypropylene, having a 565 denier in a 3×4 plain weave with 60 threads per inch in the warp and 50 ends per inch in the fill, and having a 90 percent shade factor. The seams are constructed of black thread.

Figure 10:
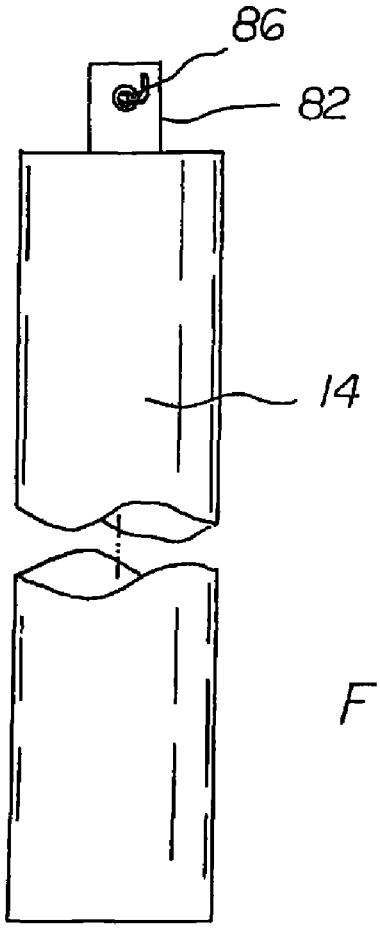
FIG. 10 is a front elevational view of the wind abatement system in a storage inoperative orientation remote from a window.

Provided last is a hanger tab 82. The hanger tab has an interior end. The interior end is attached to the primary panel adjacent to one side edge and an exterior edge. A hole and a support grommet 84 are provided remote from the primary panel. A hook 86 is provided. The support grommet is adapted to receive the hook. In this manner storage is provided when the panels are in a storage inoperative orientation remote from a recipient surface. Note FIG. 10. When the primary and secondary panels are coiled in the storage inoperative orientation remote from the recipient surfaces, supplemental bolts and washer wing nuts are utilized as show in FIGS. 9 and 10 to retain the panels in such orientation.

Reference is now made to the alternate embodiment 100 of FIGS. 4 and 6. The bolts each have threads 104. The threads are provided at the exposed ends. The bolts have washered wing nuts 106. In this manner the panel is adapted to be uncoupled from a recipient surface without removal of the bolts.

Reference is now made to the alternate embodiment 200 of FIG. 7. The bolts each have a head 204. The head is provided at the exposed end. A first L-shaped component 206 is provided. The first L-shaped component has an interior end 208. A first bolt 210 is provided. The first L-shaped component is supported by the first bolt 210. The first L-shaped component has an exterior end 212. A second L-shaped component 214 is provided. The second L-shaped component has an interior end 216. A second bolt 218 is provided. The second bolt is coupled to the exterior end of the first L-shaped component. The second L-shaped component has an exterior end 220. A third bolt 222 is provided. The third bolt couples the exterior end to a panel.

Reference is now made to the alternate embodiment 300 of FIG. 8. The bolts each have a head 304. The head is provided at the exposed end. An L-shaped component 306 is provided. The L-shaped component has an interior end 308. The interior end is supported by a bolt. The L-shaped component has an exterior end 310. A supplemental bolt 312 is provided. The supplemental bolt couples the exterior end to a panel.

Note is taken that the bolts extending into the recipient surfaces of FIGS. 7 and 8 require anchors for maximum strength. Note is also taken that the enlarged cross sectional view of FIGS. 3 through 8 do not show the secondary panel. This is to more clearly illustrate the relationship between the primary panel and the bars with regard to the bolts and recipient surfaces.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wind abatement system comprising:

a fabric primary panel having an interior and exterior face and a top and a bottom with sides;

an upper seam forming an upper passageway and a lower seam forming a lower passageway with a bar secured within each hem and a plurality of support holes extending through the hem and bar at the top and at the bottom of the primary panel;

a plurality of threaded bolts, each bolt having a threaded end adapted to be received by recipient surfaces adjacent to the top and bottom of the primary panel, each bolt having an exposed end to facilitate coupling and uncoupling, each bolt having a central portion extending through a hole in a hem and bar at the top and at the bottom of the primary panel; and a fabric secondary panel in a rectangular configuration with an interior face and an exterior face facing the interior face of the primary panel, the secondary panel having a horizontal top and a parallel horizontal bottom with parallel vertical sides adapted to overlie the sides of the primary panel, a joining seam extending through the secondary panel adjacent to the top of the secondary panel and through the primary panel spaced from the top of the primary panel, a plurality of holes with grommets adapted to overlie support holes extending through the hem and bars at the top of the primary panel whereby fasteners through the holes at the top of the primary panel and through the holes and grommets at the bottom of the secondary panel will form a cylindrical pocket for receiving the primary panel when wound spirally into a storage inoperative orientation adjacent to a recipient surface and whereby the holes and grommets at the bottom of the secondary panel will hang downwardly when the primary panel hangs downwardly in a deployed operative orientation.

2. The system as set forth in claim 1 wherein the primary panel is woven of monofilament polypropylene.

3. The system as set forth in claim 1 and further including:

a hanger tab having an interior end attached to the primary panel adjacent to one side edge and an exterior edge with a hole and a support grommet remote from the primary panel, the support grommet adapted to receive a hook for storage purposes when the panels are in a storage inoperative orientation remote from a recipient surface.

4. The system as set forth in claim 1 wherein the bolts each have a head at the exposed end.

5. The system as set forth in claim 1 wherein the bolts each have threads at the exposed ends and with washered wing nuts whereby the panel is adapted to be uncoupled from a recipient surface without removal of the bolts.

6. The system as set forth in claim 1 wherein the bolts each have a head at the exposed end and further including a first L-shaped component with an interior end supported by a first bolt and an exterior end, a second L-shaped component with an interior end with a second bolt for coupling to the exterior end of the first L-shaped component, the second L-shaped component having an exterior end coupled by a third bolt to a panel.

7. The system as set forth in claim 1 wherein the bolts each have a head at the exposed end and further including an L-shaped component with an interior end supported by a bolt and an exterior end coupled by a supplemental bolt to a panel.

8. A wind abatement system for making structures including homes, lanais, entrances, windows, garages and the like secure from high winds and hurricanes in a safe, convenient and economical manner comprising, in combination:

a fabric primary panel, in a rectangular configuration with an interior face and an exterior face, the primary panel having a horizontal top and a parallel horizontal bottom with parallel vertical sides, the top having an upper free edge being folded outwardly and overlapped about 16 inches with a plurality of parallel seams spaced apart by about 0.5 inches adjacent to the upper free edge, the bottom having a lower free edge being folded outwardly and overlapped about 16 inches with a plurality of parallel seams spaced apart by about 0.5 inches adjacent to the lower free edge, the sides having lateral free edges being folded inwardly and overlapped about 16 inches with a plurality of parallel seams spaced apart by about 3 inches adjacent to the lateral free edges;

reinforcing components including an upper seam about 1.75 inches from the top forming an upper passageway and a lower seam about 1.75 inches from the bottom forming a lower passageway, the reinforcing components including a flat primary bar measuring about 144 inches long and about 1.5 inches wide and about 0.125 inches thick adhesively secured within each hem, the reinforcing components also including a flat secondary bar measuring about 144 inches long and about 1.0 inches wide and about 0.125 inches thick adhesively secured exteriorly of each hem, the reinforcing components further including a plurality of aluminum pop rivets joining the hem and bars at the top and at the bottom and a plurality of support holes extending through the hem and bars at the top and at the bottom of the primary panel;

a plurality of threaded bolts, each bolt having a threaded end adapted to be received and supported by recipient surfaces adjacent to the top and bottom of the primary panel, each bolt having a head end exposed to facilitate rotation for coupling and uncoupling purposes, each bolt having a central portion extending through a hole in a hem and bars at the top and at the bottom of the primary panel;

a fabric secondary panel in a rectangular configuration with an interior face and an exterior face facing the interior face of the primary panel, the secondary panel having a horizontal top and a parallel horizontal bottom with parallel vertical sides adapted to overlie the sides of the primary panel, a joining seam extending through the secondary panel adjacent to the top of the secondary panel and through the primary panel about 2.5 inches from the top of the primary panel, a plurality of holes with grommets adapted to overlie support holes extending through the hem and bars at the top of the primary panel whereby fasteners through the holes at the top of the primary panel and through the holes and grommets at the bottom of the secondary panel will form a cylindrical pocket for receiving the primary panel when wound spirally into a storage inoperative orientation adjacent to a recipient surface and whereby the holes and grommets at the bottom of the secondary panel will hang downwardly when the primary panel hangs downwardly in a deployed operative orientation; and the bars being fabricated of aluminum and the panels being woven from an essentially inextensible monofilament polymer fiber, 100 percent polypropylene, having a 565 denier in a 3×4 plain weave with 60 threads per inch in the warp and 50 ends per inch in the fill, and having a 90 percent shade factor and the seams being constructed of black thread;

a hanger tab having an interior end attached to the primary panel adjacent to one side edge and an exterior edge with a hole and a support grommet remote from the primary panel, the support grommet adapted to receive a hook for storage purposes when the panels are in a storage inoperative orientation remote from a recipient surface.

* * * * *